United States Patent [19]

Ebihara et al.

[11] Patent Number: 4,687,964

[45] Date of Patent: Aug. 18, 1987

[54] APPARATUS FOR MOUNTING A FIELD EMISSION CATHODE

[75] Inventors: Ben T. Ebihara, Strongsville; Ralph Forman, Rocky River, both of Ohio

[73] Assignee: The United States of America as represented by the Administrator National Aeronautics & Space Administration, Washington, D.C.

[21] Appl. No.: 732,321

[22] Filed: May 9, 1985

[51] Int. Cl.[4] ..... H01J 1/20; H01J 1/30

[52] U.S. Cl. ..... 313/237; 313/278

[58] Field of Search ..... 313/237, 337, 271, 278, 313/279

[56] References Cited

U.S. PATENT DOCUMENTS

| | | | |
|---|---|---|---|
| 2,542,639 | 2/1951 | De Walt | 313/278 |
| 2,656,480 | 10/1953 | Corbell et al. | 313/278 |
| 2,889,478 | 6/1954 | Rogers | 313/82 |
| 3,403,281 | 9/1968 | Weaver | 313/337 |
| 3,566,179 | 2/1971 | Kumpfer | 313/337 |
| 3,662,209 | 5/1972 | Beggs | 313/237 |
| 3,727,093 | 4/1973 | Fink | 313/237 |

*Primary Examiner*—Palmer C. DeMeo
*Assistant Examiner*—Theodore Salindong
*Attorney, Agent, or Firm*—Gene E. Shook; John R. Manning

[57] ABSTRACT

A field emission cathode 12 is positioned in a pair of intersecting cross grooves 30, 32 in the end of a ceramic tube 14 by a metal end cap 24. A spring 34 in electrical contact with the base of the cathode provides the necessary pressure to maintain continuous circumferential electrical contact between the gate film and a raised edge 38 on the end cap. With this structure the cathode chip is self-centering and easily replaceable. Also the gate film of the cathode is not abraded or rubbed during installation, and the holder is readily degassed.

8 Claims, 3 Drawing Figures

APPARATUS FOR MOUNTING A FIELD EMISSION CATHODE

ORIGIN OF THE INVENTION

The invention described herein was made by employees of the U.S. Government and may be manufactured and used by or for the Government for governmental purposes without the payment of any royalties thereon or therefor.

DESCRIPTION

1. Technical Field

This invention relates to mounting a field emission cathode. The invention is particularly concerned with maintaining a small field emission cathode in an accurate alignment in an electron gun structure.

A field emission cathode is used as a source of an electron beam suitable for use in a microwave traveling wave tube. Structures for holding field emission cathodes in such devices must be capable of maintaining accurate alignment in the center, making reliable electrical contacts on both surfaces, being bakable at high temperatures in ultrahigh vacuum, and meeting compact size requirements.

A present day field emission cathode comprises a high density array of about 5,000 cones contained within an active area of only one millimeter in diameter on a 2.5 millimeter square silicon chip. Such a cathode comprises a conductor/insulator/conductor sandwich forming a gate/insulator/base. This cathode has a dielectric thickness of approximately 1.5 um having holes approximately 1.5 um in diameter in the top conductor which is a metal gate film. This cathode further has undercut cavities in the dielectric layer and metal cones within the cavities. Electrons are emitted from the cone tips utilizing a well known field emission effect when the tips are driven to a negative voltage with respect to the gate film.

Such a field emission cathode chip is conventionally mounted in a manner similar to that used in mounting a semiconductor chip. More particularly, the field emission cathode chip is placed on the top metal surface of a header of the type used to mount a semiconductor chip. This header serves to electrically connect the base of the cathode. The other necessary electrical contact to the gate film of the cathode is made by straddling two wires across the chip touching the gate film, and connecting these wires to the header leads.

The material used for fabricating the header is of metal and glass which is limited to withstand temperatures not higher than 400° C. Bakeout capability at the hightest possible temperature is essential to remove gasses and contaminants. While such a conventional holder is adequate for testing purposes, various problems are encountered which make it apparent there is a need for an improved cathode holder for use in an operating device.

Along these lines the conventional holder is limited to bakeout temperatures of less than 400° C. The material used to construct the holder should be bakeable at temperatures higher than 400° C. in order to outgas and decontaminate both the cathode and its holder to ensure adequate cleaning.

A common failure encountered with prior art holders is an electrical short occurring between the base and the gate. The causes of the failures are attributed to outgassing and contamination including residual photoresist material. Both outgassing and volitalization of the contaminants create a local high pressure region that causes an electrical discharge which may precipitate a damage severe enough to short out the cathode's base and gate together so that the cathode becomes inoperative.

2. BACKGROUND ART

U.S. Pat. No. 2,889,478 to Rogers discloses an indirectly heated cathode wherein a central aperture is provided in the emissive portion. An electrode insulated from the cathode is positioned behind it to collect positive ions.

U.S. Pat. No. 3,403,281 is directed to a magnetron having rapid starting properties when cold. This patent describes the cathode structure which utilizes a directly heated filament supported in and insulated from a helical groove formed in a solid cylindrical body.

SUMMARY OF THE INVENTION

Accordingly it is an object of the invention to provide apparatus for holding a field emission cathode that is bake at temperatures above 400° C., facilitates a more reliable electrical connection to the gate and cathode, is compact in size, and is easily installed and aligned. The apparatus of the invention is readily adaptable for use in the structure of an electron gun.

The structure of the present invention utilizes cross grooves cut on a ceramic tube to retain a small, square, thin cathode chip. With this structure the cathode chip is self-centering and easily replaceable. Also the gate film of the cathode is not abraded or rubbed during installation, and the holder is readily degassed.

Gate contacts utilized by this structure provide a continuous, circumferential, contact surface. Spring loading of the cathode chip applies pressure to the cathode ensuring good electrical contact.

BRIEF DESCRIPTION OF THE DRAWINGS

The details of the invention will be more fully described when taken with the accompanying drawings wherein.

DETAILED DESCRIPTION OF THE INVENTION

Figure 1:
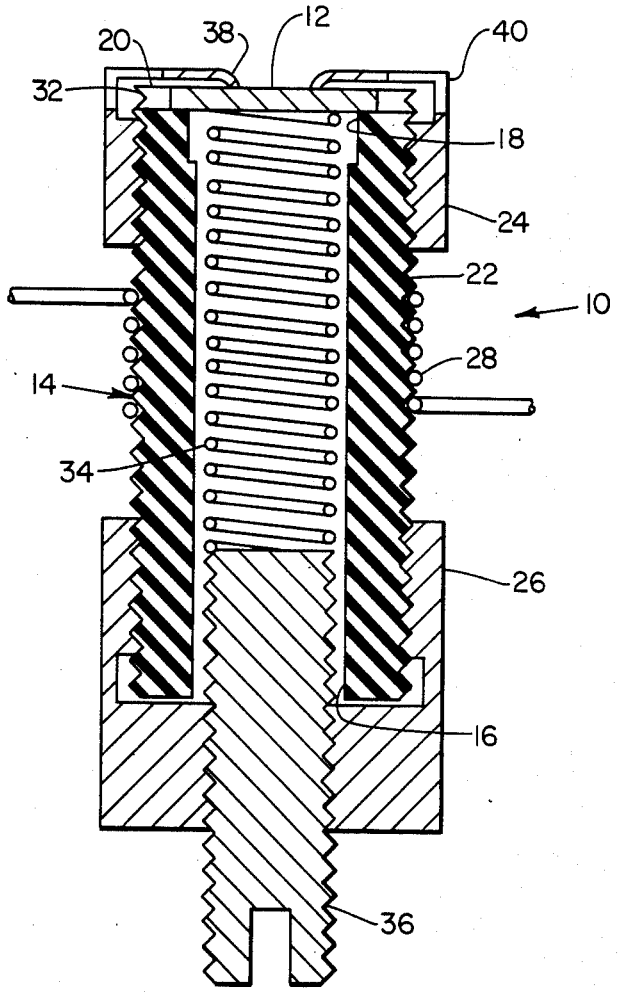
FIG. 1 is an axial section view showing a field emission cathode holder constructed in accordance with the present invention.

Referring to the drawings there is shown in FIG. 1 apparatus 10 for mounting a silicon field emission cathode chip 12 having a generally square configuration. A tubular member 14 of a suitable insulating material, such as alumina, is provided for supporting the field emission cathode 12 in a manner described later in greater detail.

An axial bore 16 extends through the insulator 14, and a circular recess 18 that is coaxial with the bore 16 extends into the outermost end face 20 of the insulator 14 that is adjacent to the cathode 12. The diameter of the recess 18 is equal to or slightly larger than the width of the cathode 12. The diameter of the recess 18 is likewise greater than the diameter of the bore 16.

Suitable threads 22 are machined on the outer surface insulator 14. A pair of metal end caps 24 and 26 are threadably mounted on opposite ends of the insulating support 14 by the threads 22.

The end caps 24 and 26 are preferably molybdenum, and they are electrically isolated from each other by the insulating support 14. The end cap 24 which is adjacent to the face 20 forms a portion of the cathode gate while the end cap 26 forms a portion of the base electrical circuit. The threads 22 also serve to support a helical tungsten resistive heating element 28 used to heat and bake out the apparatus 10.

Figure 2:
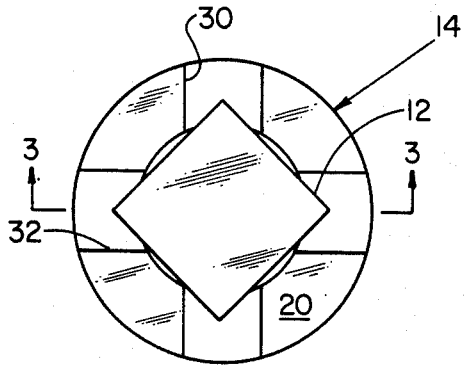
FIG. 2 is an enlarged top view of the holder shown in FIG. 1 prior to assembling the end cap.
Figure 3:
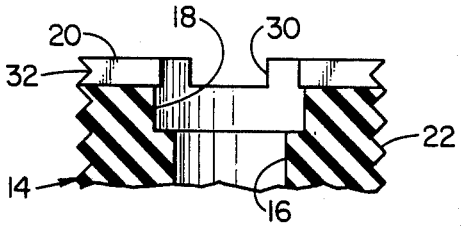
FIG. 3 is a section view taken along the line 3—3 in FIG. 2 with the cathode chip removed for clarity.

Referring now to FIGS. 2 and 3, a pair of cross grooves 30 and 32 at right angles to each other are provided in the extreme outermost end of the support 14 at the surface 20 for positioning the field emission cathode chip 12. Because the support 14 is formed of alumina the grooves 30 and 32 are readily slotted with a diamond saw.

The field emission cathode chip 12 is placed over the opening 18 in the cross grooves 30 and 32 on the end of the insulating support 14 as shown in FIGS. 1 and 2. The end cap 24 is then screwed into place as shown in FIG. 1.

A tungsten spring 34 is inserted into the bore 16 of the support 14. The end cap 26 is then assembled on the opposite end of the support 14 as shown in FIG. 1.

A suitable metal screw 36 is threadably carried in the end cap 26 and is used to compress the tungsten spring 34. This provides the necessary pressure on the field emission cathode chip 12 to make satisfactory electrical contact between the electrically conductive gate film on the outer surface of the chip and the gate at a raised edge 38 on the end cap 24. The raised edge 38 provides a continuous circumferential contact with the gate film. Satisfactory electrical contact is likewise made between the electrically conductive base on the opposite surface and the spring 34. Also the end piece 24 is suitably slotted at 40 to facilitate outgassing the internal parts.

While the preferred embodiment of the invention is disclosed and described it will be apparent that various structural modifications may be made to the device without departing from the spirit of the invention or the scope of the subjoined claims.

We claim:

1. Apparatus for mounting a field emission cathode chip having an outwardly facing gate film and an oppositely facing base comprising a support member of an insulating material for engaging the base of said cathode chip having a pair of cross grooves at right angles to each other extending into said support member from the end thereof adjacent to said chip and a substantially circular recess at the intersection of said cross grooves extending into said support member from said end for receiving said chip and positioning the same.

a first electrically conductive member removably mounted on said support member for maintaining said chip in engagement with said support member when said chip is in said recess, said first electrically conductive member being in electrical contact with said gate whereby said electrically conductive member forms a portion of said gate, a second electrically conductive member mounted on said support member remote from said first electrically conductive member, and means for electrically connecting said base of said chip to said second electrically conductive member whereby said second electrically member forms a portion of the base electrical circuit.

2. Apparatus as claimed in claim 1 wherein the cathode chip has a substantially square configuration and the diameter of said circular recess is at least equal to the width of said chip.

3. Apparatus as claimed in claim 1 wherein said first electrically conducting member has a substantially circular raised edge to provide a continuous circumferential contact with said gate film.

4. Apparatus as claimed in claim 3 wherein the means for electrically connecting the base of the chip to the second electrically conductive member includes a resiliant member for applying pressure to said base of said chip thereby maintaining the electical contact between said raised edge and said gate.

5. Apparatus as claimed in claim 4 including means for selectively applying a force to said resiliant member to vary said pressure applied to said base.

6. Apparatus as claimed in claim 5 wherein the support member has a tubular configuration with an axial bore extending therethrough, said resiliant member comprises a spring mounted in said bore, and said force applying means comprises a screw member threadably mounted in said second electrically conductive member in contact with said spring.

7. Apparatus as claimed in claim 1 including means for heating said support member.

8. Apparatus as claimed in claim 7 wherein said heating means comprise a tungsten resistive heating element mounted on the outer surface of said support member.

* * * * *